United States Patent [19]

Straujups

[11] 4,000,863

[45] Jan. 4, 1977

[54] WINDING APPARATUS WITH WRAPPING ARRANGEMENT

[75] Inventor: John E. Straujups, Lexington, Mass.

[73] Assignee: Birch Brothers Southern, Inc., Waxhaw, N.C.

[22] Filed: June 13, 1975

[21] Appl. No.: 586,742

[52] U.S. Cl. ..... 242/56 R; 242/66

[51] Int. Cl.[2] ..... B65H 19/20

[58] Field of Search ..... 242/66, 65, 56 R

[56] References Cited

UNITED STATES PATENTS

| | | | |
|---|---|---|---|
| 3,047,248 | 7/1962 | Birch | 242/56 R |
| 3,049,311 | 8/1962 | Birch | 242/56 R |
| 3,167,268 | 1/1965 | Birch | 242/56 R |
| 3,485,121 | 12/1969 | Birch | 242/56 R |
| 3,727,853 | 4/1973 | Kinoshita | 242/56 A |
| 3,910,517 | 10/1975 | Harrison | 242/56 R |

*Primary Examiner*—Edward J. McCarthy
*Attorney, Agent, or Firm*—Bell, Seltzer, Park & Gibson

[57] ABSTRACT

A winding apparatus of the type in which a roll of web material is supported at a first winding position and in engagement with one of a plurality of driving rolls during initiation of winding and is then supported at a second winding position and in engagement with another driving roll during continuation of winding, the apparatus having an arrangement for folding a leading end portion of web material and tucking the folded web material about a winding core positioned at the first winding position for initiation of winding of web material thereon.

9 Claims, 6 Drawing Figures

WINDING APPARATUS WITH WRAPPING ARRANGEMENT

Web materials of various types have heretofore been wound into rolls by using apparatus which supports a winding core at a first winding position for initiation of winding of web material thereabout and then supports the roll of web material at a second winding position during continuation of winding to a final size. Such apparatus, particularly as exemplified by U.S. Pat. Nos. 3,167,268; 3,049,311 and 3,047,248 owned in common with the present invention, have achieved significant success in handling web materials ranging from thin low density foam products to heavy and stiff floor covering materials. In such applications, one significant advantage is the ability to "batch" or form a successive plurality of rolls of web material from an essentially continuous supply of such material to the winder by severing advancing web material which is guided to the winding positions and directing a leading end of the web material thus formed to pass about a winding core.

In accomplishing such formation of successive rolls, problems have been presented wherein the web material has sufficient stiffness to at least somewhat resist wrapping about a winding core. While many web materials, such as thin flexible foams or lightweight textile fabrics, do not present difficulty and are readily wrapped about a winding core positioned at the first winding position (as shown by the aforementioned related United States patents), increasing use of such winding apparatus with thicker foams and with relatively stiff materials has resulted in a greater awareness of the problem of securely wrapping a leading end of web material about a winding core. With certain materials, it has been found that the material may be directed to pass about a winding core but that the reverse or 180° bend thus formed does not necessarily cause positive and secure wrapping of the leading end about the core. In particular, thicker foams are subject to having the leading end pass back along the path along which web material is supplied for winding, precluding formation of a roll and leading to disruption of the winding process.

With the aforementioned difficulty in mind, it is an object of this invention to securely and positively wrap a leading end of web material about a winding core. In realizing this object of the present invention, an arrangement is provided for folding or tucking a leading end portion of the web material and inserting the folded portion into a nip defined between the winding core and the web material to be wound thereabout. By thus positively gripping a folded leading end portion, proper initiation of winding is assured even where a relatively thick foam or stiff material is being handled.

Yet a further object of this invention is to accomplish the severance of a wound roll from a continuing supply of web material and the positive initiation of winding of a next subsequent roll in desired timed relation. In realizing this object of the present invention, control is exercised over the operation of a tucking device which folds and tucks a leading end portion by coordination with the cutting of the web material and redirection of the leading end portion toward the location at which folding and tucking occur.

Some of the objects of the invention having been stated, other objects will appear as the description proceeds, when taken in connection with the accompanying drawings, in which FIG. 1 is an elevation view, partially in phantom lines and partially schematic, illustrating an apparatus incorporating the present invention;

The present invention will be described hereinafter with particular reference to the accompanying drawings, with the description and drawings being intended to set forth the best mode contemplated for the present invention at the time that the description and drawings are prepared. It is to be understood at the outset that the present invention is contemplated as having general utility with winding apparatus of the general class described, and that the description and illustration of the best mode presently contemplated is not to be understood as limiting upon the possible further utility or modification of this invention. Instead, it is intended that the description and illustrations be taken as a broad teaching of this invention.

Figure 1:
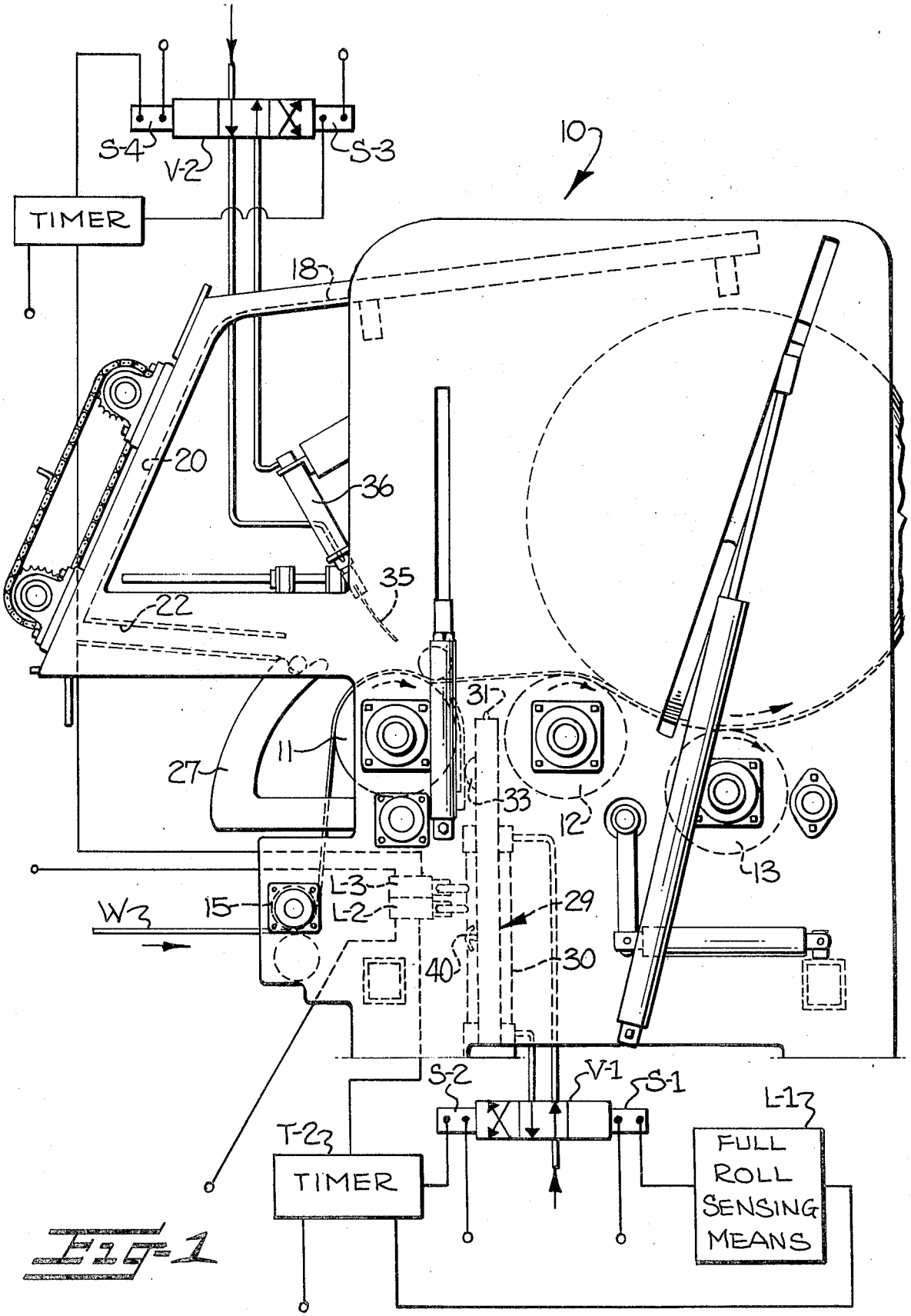
Figure 2:
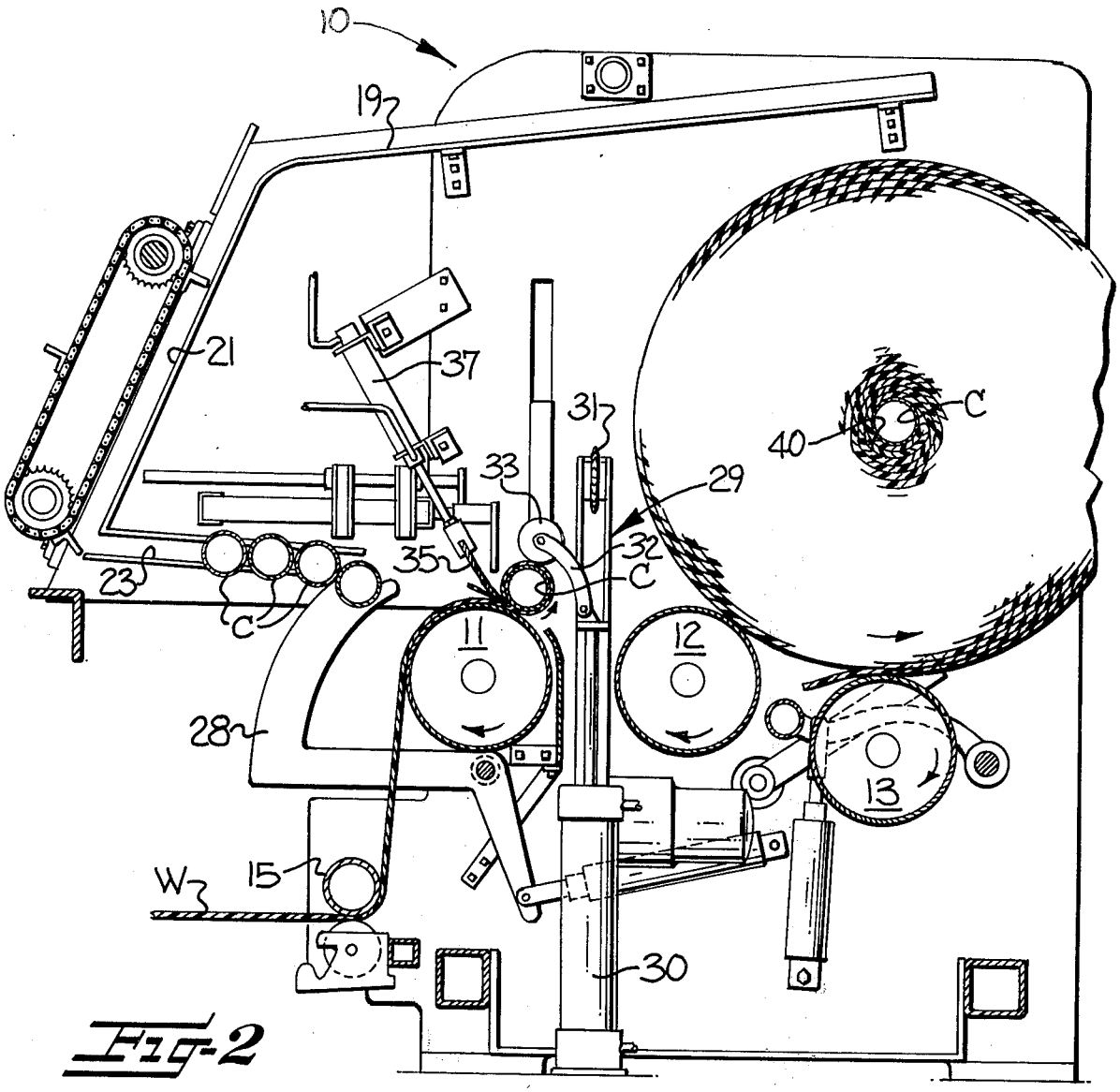
FIG. 2 is a section view generally similar to FIG. 1 and illustrating the initiation of winding of a roll.

Referring now more particularly to FIGS. 1 and 2, the winding apparatus of the present invention, generally indicated at 10, has a plurality of elongate driving rolls 11, 12, 13 mounted for rotation about parallel spaced apart axis. As will be appreciated from the descriptions of the aforementioned United States patents (hereby incorporated by reference into this description to the extent necessary for full understanding of this invention), the driving rolls 11, 12, 13 cooperate for supporting a roll of web material at a first winding position and in engagement with one driving roll 11 during initiation of winding and then supporting the roll of web material at a second winding position and in engagement with another driving roll 12 during continuation of winding. Web material W is guided to the winding positions by an entry roll 15, and passes over the one driving roll 11 during winding at either of the first and second winding positions. Conventionally, the web material W is wound about a winding core C.

The winding apparatus 10 includes means for positioning winding cores C at the first winding position for initiation of winding of web material thereon. In the form illustrated, the means employed includes a magazine formed by spaced apart inclined upper trackways 18, 19; vertically directed chutes 20, 21; and generally horizontally extending lower trackways 22, 23. The lower trackways 22, 23 normally retain a plurality of winding cores C, with one being retained by a pair of load arms 27, 28 in readiness for movement to the first position. As will be understood from the more complete description presented in the aforementioned related United States patents, the load arms 27, 28 are moved by appropriate actuating means to transport a winding core C along a predetermined path of travel to the first position and thereby position the winding core for initiation of winding of web material thereon.

The apparatus 10 has means movable transversely of the web material between the first and second winding positions for severing a wound roll from advancing web material and for directing a leading end of the web material about a winding core positioned at the first winding position. The transversely movable means includes a carriage 29 (FIG. 5) which is supported by frame members of the apparatus 10 for movement from a withdrawn position on one side of the path of travel of the web material W to an extended position on the other side thereof. In the form illustrated and as described in the aforementioned related patents, the carriage 29 moves vertically upwardly from a position below the web material W to a position thereabove. Such movement is accomplished by an appropriate drive, such as an expansible chamber actuator device 30.

The carriage 29 preferably supports a moving chain cutter 31, having a toothed chain drive laterally of the web material W for severing the same. Additionally, the carriage 29 supports a plurality of sets of pivot arms 32, each set mounting a corresponding roller 33 for the purpose of directing a leading edge of web material as described more fully hereinafter.

In accordance with the present invention and in order to securely wrap a leading end of web material about a winding core, the present invention provides tucking means for folding a leading end portion of web material about a line spaced from a leading edge thereof and for biasing the folded web material into a nip defined between the web material and the core. In the particular form illustrated, the tucking means comprises an elongate blade 35 having a length substantially equal to the length of the winding core C and mounted substantially parallel to the driving rolls 11, 12, 13. The blade 35 is mounted for movement between a position withdrawn from the first winding position (FIG. 5) and a tucking position closely adjacent the first winding position (FIG. 2). In the form illustrated, the elongate blade 35 is mounted by a pair of expansible chamber actuator devices 36, 37, by connection of the exposed piston rods of those devices with opposite terminal end portions of the blade 35. The cylinder devices 36, 37 are mounted in any suitable way from the frame of the winding apparatus 10.

Figure 3:
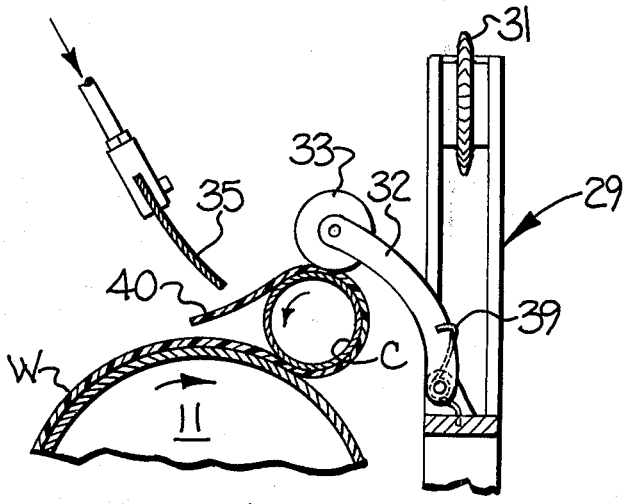
FIG. 3 is an enlarged elevation view, partially in section illustrating a transient stage in the initiation of winding of a roll of web material.
Figure 4:
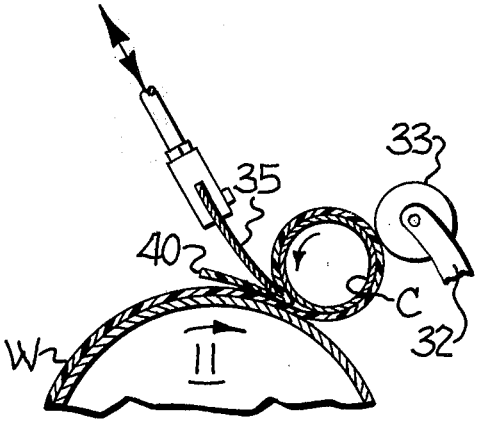
FIG. 4 is a view similar to FIG. 3, illustrating a transient stage in the initiation of winding shortly subsequent to the stage of FIG. 3.

The present invention further includes control means for moving the blade 35 from the withdrawn position toward the tucking positions as a leading end of web material is guided about a winding core positioned at the first winding position. This control means as described more fully hereinafter, assures movement of the blade in predetermined timed relation with movement of the transversely movable means including the carriage 29. Due to such timed relationship of movements, the blade when moving to the tucking position (FIG. 3) engages web material W in spaced relation to a leading end 40 thereof for folding the web material W about the blade 35 (FIGS. 2 and 4). The path of movement of the blade 35 is such that the folded web material is biased into a nip defined between the winding core C and the web material W passing in engagement with the one driving roll 11 (FIG. 4). Thus, the leading end of the web material is securely wrapped about the winding core C and initiation of winding is assured.

Preferably, the elongate blade 35 is somewhat curved in cross-section (FIGS. 2–4) and is formed of some relatively flexible yet rigid material such as sheet metal. The resilience of the blade 35, together with the curved configuration, provides at least a portion of the force biasing the folded web material into the nip (FIG. 4) while additionally facilitating withdrawal of the blade 35 from the tucking position upon operation of control means as will be now described.

Figure 6:
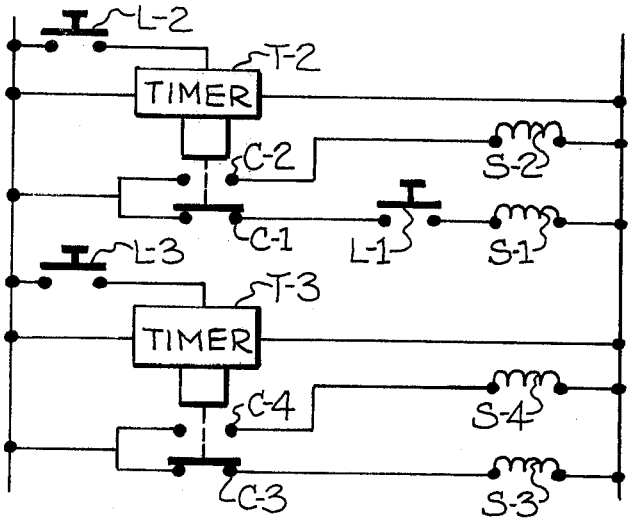
FIG. 6 is a schematic electrical diagram of portions of a control incorporated in the apparatus of FIGS. 1 thru 5.

Referring now more particularly to FIGS. 1 and 6, the control means preferably includes a device L1 for sensing completion of winding of a roll of web material. In accordance with the aforementioned United States patents, the full roll sensing device L1 may take the form of a limit switch responsive to the diameter of the roll being wound, a yardage counter responsive to the length of web material wound into the roll, a seam detector responsive to passage of a seam joining successive portions of web material or some combination of such means. For convenience, the full roll sensing means L1 is shown in FIG. 6 as a limit switch. Closure of that limit switch energizes a solenoid S1 controlling the position of a first fluid pressure directing valve V1.

The first valve V1 is operatively connected to actuating cylinder 30 for the carriage 29 of the transversely movable means and normally applies actuating pressure fluid in such a manner as to maintain the carriage 29 in the withdrawn position. Upon energization of the solenoid S1, the first valve V1 changes position so as to apply actuating pressure to the cylinder 30 and moves the carriage 29 toward the extended position.

Figure 5:
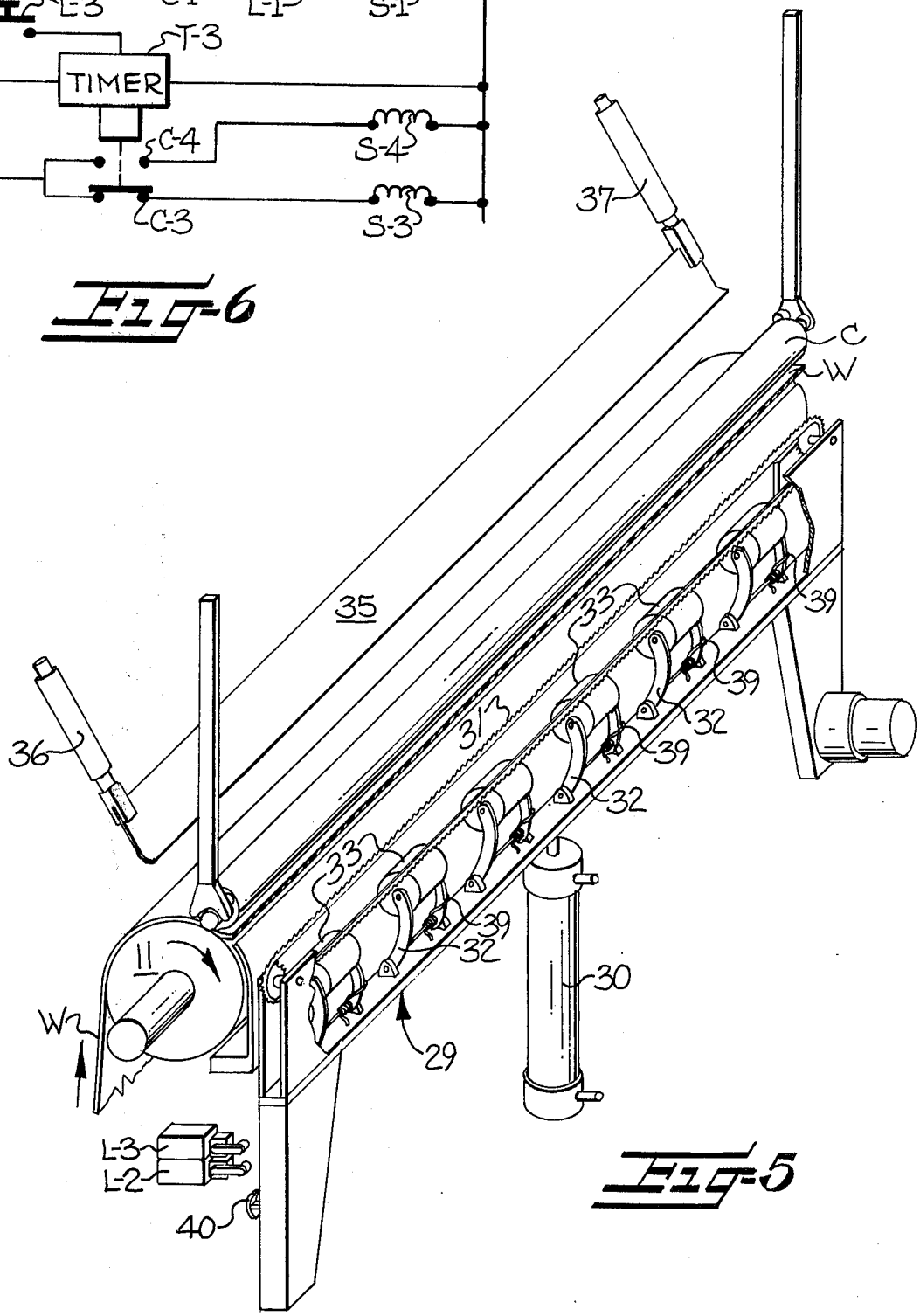
FIG. 5 is a perspective view of elements of the apparatus of FIGS. 1 and 2.

As the carriage 29 rises, a cam abutment 40 (FIG. 5) engages a pair of limit switches L2, L3. Closure of the contacts of the limit switches L2, L3 energizes corresponding ones of first and second timers T2, T3. The first timer T2 controls a corresponding pair of contacts C1, C2 which control energization of the solenoids S1, S2 for the first valve V1 operatively connected to the carriage lift cylinder 30. The second timer T3 controls a corresponding pair of contacts C3, C4 which control energization of the solenoids S3, S4 operating a second valve V2 which is operatively connected with the cylinders 36, 37 which mount the blade 35. It will be noted from FIG. 6 that closure of the full roll sensing device L1 completes a circuit including the contact C1 of the first timer T2 in energizing the solenoid S1 of the first valve V1. The normally closed position of one contact C3 of the second timer T3 normally energizes one solenoid S3 of the second valve V2 operatively connected to the cylinders 36, 37. This normal energization applies actuating pressure to the cylinders 36, 37 in such a way as to maintain the blade 35 in the withdrawn position (FIG. 5).

As the first and second timers T2, T3 time out respective intervals, the carriage 29 moves upwardly and the cutter 31 severs the web W between the first and second winding positions. Continued upward movement of the carriage 29 causes the pivot arms 32 and the rollers 33 carried thereby to be moved outwardly of the carriage 29 by torsion springs 39, toward the first winding position. With such movement, the rollers 33 engage the leading end portion of the severed web material W and direct the web material to pass about a core C positioned at the first winding position (FIG. 3), as is described in the aforementioned related United States patents. Upon completion of the interval timed by the first timer T2, the contact C1 through which the solenoid S1 has been energized is opened and the contact C2 is closed to energize the opposing solenoid S2 which shifts the position of the first valve V1 so as to apply actuating pressure fluid to reverse the direction of movement of the carriage 29. Upon completion of the interval for which the second timer T3 is set, the contact C3 through which the solenoid S3 of the second valve V2 has been energized is opened and the contact C4 is closed to energize the opposing solenoid S4 of that valve. Upon the resulting movement of the second valve V2, actuating pressure fluid is applied to the cylinders 36, 37 to move the blade 35 toward the tucking position (FIG. 3), with it being understood that such movement is in timed relation to the movement of the carriage 29 which causes the rollers 33 and pivot arms 32 to perform the initial redirection of the leading end portion of the web material W. As the blade 35 moves toward the first winding position, the edge of the blade engages the web material W along a line adjacent to but spaced from the severed free end, so as to fold the web material about the blade. Continued movement of the blade 35 biases the folded web material into a nip defined between the winding core C and the web material W passing in engagement with the one driving roll 11 (FIG. 4). As a result, the leading end of the web material W is securely wrapped about the winding core C.

With completion of timing of the interval for which the second timer T3 is set, the contact C4 which has controlled energization of the solenoid S4 of the respective valve V2 is opened and the contact C3 is closed to again return the blade 35 to the withdrawn position.

In the drawings and specification, there has been set forth a preferred embodiment of the invention, and although specific terms are employed, they are used in a generic and descriptive sense only and not for purposes of limitation.

That which is claimed is:

1. A winding apparatus comprising a plurality of elongate driving rolls mounted for rotation about parallel spaced apart axes for guiding forwardly advancing web material to be wound into a roll while supporting the roll of web material at a first winding position and in engagement with one of said driving rolls during initiation of winding and then supporting the roll of web material at a second winding position and in engagement with another of said driving rolls during continuation of winding, means for positioning winding cores at the first winding position for initiation of winding of web material thereon, carriage means movable transversely of the web material between the first and second winding positions, cutting means movable with said carriage means for engaging web material between the first and second winding positions and for severing the web material and forming a leading edge of forwardly advancing web material between the first and second winding positions, means for directing the leading edge of web material rearwardly about a winding core positioned at the first winding position, tucking means mounted for movement between a position withdrawn from the first winding position and a tucking position closely adjacent the first winding position and for engaging a rearwardly directed leading end portion of web material substantially throughout the width thereof for folding the web material about a fold line spaced from the leading edge of the web material while biasing the folded web material into a nip defined between the web material and the winding core at the first winding position, and control means including means for moving said tucking means from the withdrawn position toward the tucking position in timed relation to movement of said carriage means and as a leading end portion of web material is directed rearwardly about a winding core.

2. A winding apparatus according to claim 1 wherein said tucking means comprises blade means for extending substantially throughout a length equal to the length of a winding core and means mounting said blade means substantially parallel to said driving rolls for movement between the withdrawn position and the tucking position.

3. A winding apparatus according to claim 1 wherein said means for directing web material rearwardly comprises a plurality of pivotal arm means mounted on said carriage means and a corresponding plurality of web material engaging rolls, each mounted on a corresponding one of said arm means for engaging a leading end portion of severed web material and directing an engaged portion about a winding core.

4. A winding apparatus according to claim 1 wherein said cutting means comprises chain means supported on said carriage means for movement laterally of web material being severed and drive means for moving said chain means during severance of web material.

5. A winding apparatus according to claim 1 wherein said means for positioning winding cores comprises means for sequentially feeding winding cores along a predetermined path of travel to the first winding position for winding of successive rolls of web material.

6. A winding apparatus comprising a plurality of elongate driving rolls mounted for rotation about parallel spaced apart axes for guiding forwardly advancing web material to be wound into rolls while supporting a roll of web material at a first winding position and in engagement with one of said driving rolls during initiation of winding and then supporting the roll of web material at a second winding position and in engagement with another of said driving rolls during continuation of winding, magazine means for receiving and retaining a plurality of winding cores, means for sequentially feeding winding cores along a predetermined path of travel from said magazine means to the first winding position for winding of successive rolls of web material, carriage means movable transversely of the web material between the first and second winding positions, cutting means carried by said carriage means for severing web material between the first and second winding positions and forming a leading edge of forwardly advancing web material, means carried by said carriage means for directing the leading edge of web material rearwardly about a winding core positioned at the first winding position, tucking means mounted for movement between a position withdrawn from the path of travel of cores being fed to the first winding position and a tucking position closely adjacent the first winding position and for engaging a rearwardly directed leading end portion of web material substantially throughout the width thereof for folding the web material about a fold line spaced from the leading edge of the web material while biasing the folded web material into a nip defined between the web material and the winding core at the first winding position, and control means including means for moving said tucking means from the withdrawn position toward the tucking position in timed relation to movement of said carriage means and as a leading end portion of web material is directed rearwardly about a winding core.

7. A winding apparatus according to claim 6 wherein said control means further comprises means responsive to winding of a roll of web material to a predetermined final size and operatively connected with said carriage means and said tucking means for initiating a sequence of movement thereof in response to winding of a roll of web material to final size.

8. A winding apparatus according to claim 6 wherein said tucking means comprises an elongate blade having a length substantially equal to the length of a winding core and actuator means mounting said blade substantially parallel to said driving rolls for movement between the withdrawn position and the tucking position.

9. A method of winding web material about an elongate winding core to form a manual roll thereof comprising supporting a core in a first winding position while winding forwardly advancing web material thereabout to a predetermined initial size roll, supporting the roll in a second winding position for continuation of winding to a final size, severing the forwardly advancing material between the first and second winding positions while separating a roll wound to final size and forming a leading end of forwardly advancing web material, positioning a succeeding elongate winding core in the first winding position, directing the leading edge of the web material rearwardly about the winding core positioned at the first winding position, and folding the web material about a fold line spaced from the leading edge of the web material while tucking the fold line portion of the web material into a nip defined between the web material and the winding core at the first position with the leading edge portion projecting rearwardly therefrom.

* * * * *